United States Patent [19]

Bone

[11] Patent Number: 4,949,613

[45] Date of Patent: Aug. 21, 1990

[54] CUTTING OF MATERIALS

[76] Inventor: Arnold R. Bone, 25 Bradford St., Needham, Mass. 02192

[21] Appl. No.: 427,486

[22] Filed: Sep. 29, 1982

[51] Int. Cl.[5] ..... B26D 5/08

[52] U.S. Cl. ..... 83/574; 30/371; 30/381; 83/796

[58] Field of Search ..... 30/296 R, 371, 372, 30/381; 83/574, 796; 209/102

[56] References Cited

U.S. PATENT DOCUMENTS 4,127,046 11/1978 Jackson ..... 83/574 X 4,307,640 12/1981 Michael ..... 83/796 X

*Primary Examiner*—Douglas D. Watts

*Attorney, Agent, or Firm*—George E. Kersey

[57] ABSTRACT

A device for cutting logs which involves swinging a chain saw about a fixed pivot to bring the chain of the saw into cutting engagement with a log while the log is supported in elevated position the apparatus includes a table having a log supporting top, and a pivoted mounting plate for the chain saw.

7 Claims, 2 Drawing Sheets

CUTTING OF MATERIALS

BACKGROUND OF THE INVENTION

This invention relates to the cutting of materials, and, more particularly, to the facilitation of cutting operations.

Cutting operations can be effected in many ways. One of the most useful incorporates a chain saw, in which a motor driven chain with cutting elements rotates about an elongated support known as a cutter bar.

In the use of the chain saw, the cutter bar is brought into contact with the materials to be cut. Unfortunately, the chain saw can be unwieldy and difficult to use with such materials as brush and the branches of trees. Even where the cutting operations is comparatively simple, special care must be taken to guard against accidents.

Accordingly, it is an object of the invention to facilitate cutting operations. A related object is to facilitate such operations using a chain saw.

Another object of the invention is to guard against accidents in the use of cutting instrumentalities such as chain saws. A related object is to avoid the need for unbalanced and unwieldy movements in the use of cutting instrumentalities such as chain saws.

Being a motor driven device, with a two-cycle engine, it is often comparatively difficulty to start. Typical starting instructions require two handed operation. One hand grips the handle and the other pulls on the starting cord. As a result the chain saw is in unstable equilibrium and there is a possibility of unbalanced movement of the saw and consequent accidental cutting.

Accordingly, it is another object of the invention to facilitate the starting of motor driven cutting instrumentalities such as chain saws. A related object is to promote safe starting.

SUMMARY OF THE INVENTION

In accomplishing the foregoing and related objects, the invention provides for facilitating the operation of a cutting instrumentality, such as a chain saw, by pivotally supporting the instrumentality and securing the support to a mount with the cutting instrumentality supported below the upper level of the mount.

In accordance with one aspect of the invention, the pivotal support includes a spindle for supporting the cutting instrumentality below the upper level of the mount. Provision is also made where necessary to adapt the cutting instrumentality to be received by the spindle. In the case of a conventional chain saw, this can be achieved by incorporating a cylindrical sleeve below the base surface of the saw, extending from a lower previously applied chain saw connector to the base position of the conventional side handle commonly found in chain saws. The lower connector is a conventional machine screw that is used to affix a guard shield on the saw at the motor drive position for the saw blade. The other end of the cylinder is attached to the base portion of the side handle by a wing that projects outwardly from the cylinder.

In accordance with another aspect of the invention, the support member is in the form of a flange with a first section for connection to the mount and a second section extending from the first section and containing the spindle which is used to receive the cutting instrumentality. The second section extends at an angle with respect to the first section which is desirably greater than 90°.

In accordance with a further aspect of the invention, the second section includes a backstop beyond the position of the spindle to provide temporary support for the chain saw. A pivoted lever on the backstop can be used for securing the chain saw on the support with respect to its spindle.

In use of the support, the chain saw with its adaptor, such as a base mounted cylindrical sleeve, is positioned on the spindle using the sleeve, the retention lever on the backstop is pivoted to secure the chain saw on the sleeve and the saw is started. Because of the stability imparted by the mount supported spindle, the starting operation is simply a matter of pulling on the starting cord while the other hand holds the saw against the backstop of the support. Once the saw is started it is easily used by simply pivoting the saw about the spindle with the items to be cut fed into the cutting path. Where the mount for the support is a bench, the feeding operation merely involves moving the items to be cut along the top surface of the bench to the cutting position.

DESCRIPTION OF THE DRAWINGS

Other aspects of the invention will become apparent after considering several illustrative embodiments taken in conjunction with the drawings in which.

DETAILED DESCRIPTION

Figure 1:
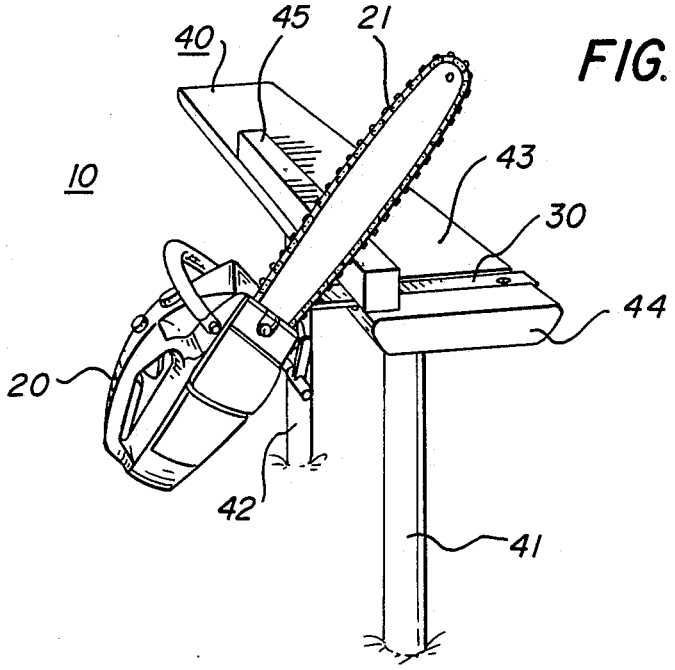
FIG. 1 is an overall view showing a chain saw adapted for cutting and starting in accordance with the invention.

With respect to the drawings, FIG. 1 shows a system 10 for facilitating the operation of a chain saw 20 in accordance with the invention. The chain saw 20 is pivotally positioned on a support 30 which is in turn secured to a mount 40.

In FIG. 1 the mount 40 is a bench with legs 41 and 42 that support the upper surface 43 of the mount 40 at a convenient height. Near one end of the support surface 43 the support member 30 is secured by conventional fasteners. The exact position of the support 30 on the mount surface 43 depends upon the chain saw 20 and is sufficient to permit the bar 21 of the saw 20 to clear the end 44 of the mount 40. Additional security is provided by a shield 45 at the edge of the mount 40 nearest the user. In addition the shield 45 increases the firmness with which the support 30 is held to the surface 43. It will be understood that the shield may be extended upwardly to any convenient height to provide additional security and guidance for objects fed along the surface 43 for cutting.

Figure 2:
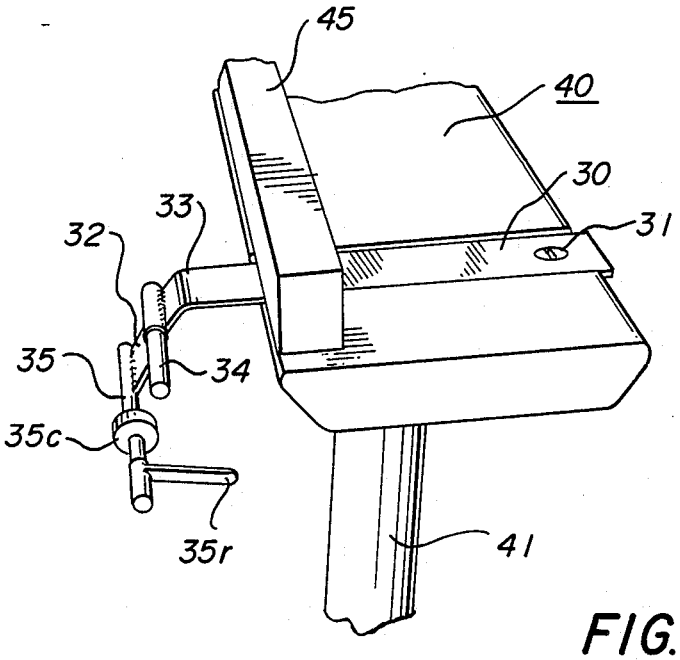
FIG. 2 is a perspective view of a support on a mount for the chain saw of FIG. 1.

Details of the support 30 are shown in FIG. 2. The support 30 is in two sections 31 and 32. The first section 31 is generally horizontal and has an end which projects outwardly from beyond the shield 45. At the end of the projection, the second section 32 is integrally secured at a bend 33. The second member 32 includes a spindle 34 below the bend 33 and a support 35 at the end of the section 32. The spindle 34 is adapted for receipt of the chain saw which can be modified as explained below.

The support 35 provides a temporary backrest so that when the chain saw 20 is unattended, it adopts the position shown in FIG. 1.

The backrest 35, as seen in FIG. 2, includes a cushion 35*c* in the form of a cylinder and a retainer 35*r*, in the form of a pivoted handle. After the chain saw 20 is placed on the spindle 34, the retainer 35*r* is pivoted upwardly to prevent accidental dislodgement of the saw from the spindle. The retainer 35*r* is secured to the backrest arm 35 in any convenient way.

Figure 3:
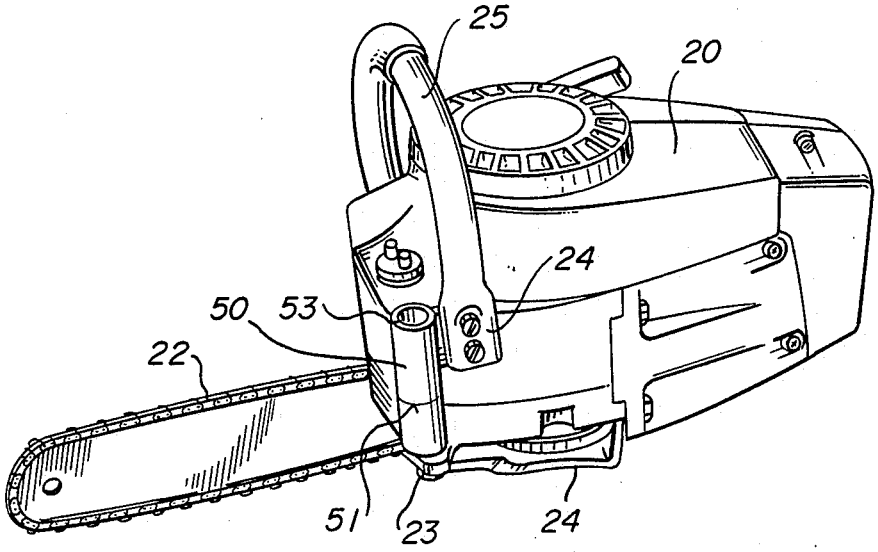
FIG. 3 is a bottom view of the chain saw of FIG. 1 showing an adaptor for accommodating the saw to the support of FIG. 2.

One adaptation of the chain saw 20 for positioning on the spindle 34 is shown in FIG. 3. A mounting sleeve 50 has one end 51 secured by the fitting 23 that normally holds the guard cover 24 at the motor drive position for the chain 22. The sleeve 50 is conveniently threaded on the fitting 23. The other end 52 of the sleeve 50 includes a tab 53 that extends outwardly from the sleeve 50. The tab may be secured to the sleeve 50 by conventional welding. The tab 53 is inserted below the connection point 24 of the side handle 25.

Figure 4:
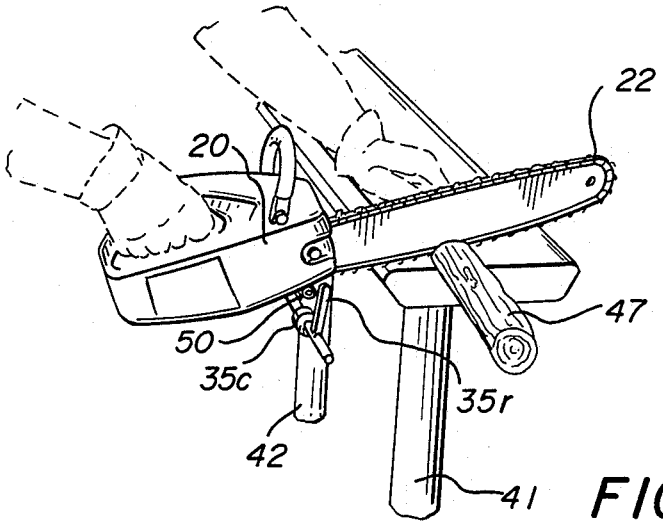
FIG. 4 is an overview showing the system of FIG. 1 in use.

Using the sleeve 50 the saw 20 is readily fitted onto the support 30 at the spindle 34, adopting the position shown in FIG. 1. It will be apparent that with the saw 20 in this position it can be conveniently started. Once started, the saw 20 can be used as shown in FIG. 4 by pivoting the saw 20 to bring the rotating chain 22 into contact with the work piece 47.

While various aspects of the invention have been set forth by the drawings and specification, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. Apparatus for facilitating the operation of a cutting instrumentality, which comprises:

a member having a first section for attachment solely to the surface of a mount that receives a work piece to be acted upon by said cutting instrumentality;

said member having a second section, integral with the first section, extending outwardly and downwardly with respect to the surface of said mount when said member is attached to said mount;

said second section including a spindle extending outwardly from only one side of said member for acting as the sole pivotal support for said cutting instrumentality; and said second section further including, beyond said spindle at a free end of said second section, a retainer that is upwardly pivotable when said cutting instrumentality is pivoted on said spindle, to prevent accidental dislodgment of said cutting instrumentality from said spindle.

2. Apparatus for facilitating the operation of a cutting instrument which comprises:

cantilever means for pivotally supporting the cutting instrumentality, and means for securing the supporting means as a cantilever to a mount, and means for supporting the cutting instrumentality below the upper level of said mount where said supporting means include a spindle, and means for adapting said cutting instrumentality to be received by said spindle by a cylindrical sleeve connected thereto means wherein said cutting instrumentality is a chain saw having a handle and a plate fastening screw on the nominal underside of said chain saw and said sleeve extends between said handle of said chain saw and said plate fastening screw.

3. Apparatus for facilitating the operation of a cutting instrumentality, which comprises a member having a first section for attachment solely to the surface of a mount that receives a work piece to be acted upon by said cutting instrumentality;

said member having a section, integral with the first section, extending outwardly and downwardly with respect to the surface of said mount when said member is attached to said mount;

said second section including a spindle and further including, beyond said spindle at a free end of said second section a retainer that is upwardly pivotable when said cutting instrumentality is pivoted on said spindle, to prevent accidental dislodgement of said cutting instrumentality from said spindle.

4. Apparatus as defined in claim 1 wherein said second section includes, beyond said spindle at said free end, a support for said cutting instrumentality when pivotally positioned on said spindle.

5. Apparatus as defined in claim 4 wherein said retainer extends beyond said one side of said member at said support and a cylindrical cushion is included on said support.

6. Apparatus as defined in claim 1 wherein said second section is connected to said first section at a bend of said member which provides an angle between said first section and said second section greater than 90 degrees.

7. Apparatus for facilitating the operation of a cutting instrument which comprises:

cantilever means for pivotally supporting the cutting instrumentality, and means for securing the supporting means as a cantilever to a mount, and means for supporting the cutting instrumentality below the upper level of said mount where said supporting means includes a spindle, and means for adapting said cutting instrumentality to be received by said spindle by a cylindrical sleeve connected thereto, means wherein said cutting instrumentality is a chain saw having a handle and a plate fastened screw on the nominal underside of said chain saw and said sleeve extends between said handle of said chain saw and said plate fastening screw.

* * * * *